United States Patent [19]

Newton et al.

[11] 4,132,922

[45] Jan. 2, 1979

[54] GAS-FILLED INCANDESCENT LAMP WITH INTEGRAL FUSE ASSEMBLY

[75] Inventors: Ralph E. Newton, Dover; Henry M. Nixon, Westfield, both of N.J.

[73] Assignee: Westinghouse Electric Corp., Pittsburgh, Pa.

[21] Appl. No.: 841,771

[22] Filed: Oct. 13, 1977

[51] Int. Cl.[2] ..... H01K 1/66; H01J 7/44

[52] U.S. Cl. ..... 315/73; 313/315

[58] Field of Search ..... 315/73, 74; 313/315

[56] References Cited

U.S. PATENT DOCUMENTS

| | | | |
|---|---|---|---|
| 3,211,942 | 10/1965 | Wiley | 313/315 |
| 3,211,943 | 10/1965 | Cardwell, Jr. | 315/74 X |
| 3,211,950 | 10/1965 | Cardwell, Jr. | 315/74 |
| 3,274,426 | 9/1966 | Scoledge et al. | 315/74 X |
| 3,346,768 | 10/1967 | Patsch | 315/74 |
| 3,710,169 | 1/1973 | T'Jampens et al. | 313/317 X |
| 3,727,091 | 4/1973 | DeCaro | 315/74 X |
| 3,864,598 | 2/1975 | Cardwell, Jr. | 315/74 |
| 3,930,177 | 12/1975 | Martin | 313/271 |
| 4,066,926 | 1/1978 | Newton | 315/73 |

FOREIGN PATENT DOCUMENTS

| | | | |
|---|---|---|---|
| 21968 | 4/1972 | Japan | 315/73 |
| 30707 | 9/1973 | Japan | 315/73 |

*Primary Examiner*—Alfred E. SMith
*Assistant Examiner*—Charles F. Roberts
*Attorney, Agent, or Firm*—D. S. Buleza

[57] ABSTRACT

Protection against potentially destructive arcs which may occur within a gas-filled incandescent lamp when the energized filament fails is achieved by partly embedding separate inner and outer lead-in conductors in an hermetic seal that is formed on one end of the lamp envelope and electrically connecting the conductors by a short uncoiled fuse element that is located within the confines of the envelope and has both of its ends embedded in the seal. In the case of halogen-cycle type lamps that have long useful design lives (in the order of 2000 hours) and press-sealed envelopes, the fuse element comprises a tungsten wire that has a diameter which is more than 10% (and up to about 20%) larger than the diameter of the filament wire and has its ends welded to a pair of molybdenum foil conductors that are embedded in the press seal and connect the fuse wire to the inner and outer lead-in conductors. Reliable arc-suppression is thus achieved in a practical and inexpensive manner with rugged sealed-in components that are readily welded together and made integral parts of the finished lamps.

10 Claims, 3 Drawing Figures

GAS-FILLED INCANDESCENT LAMP WITH INTEGRAL FUSE ASSEMBLY

CROSS-REFERENCE TO RELATED APPLICATIONS

The subject matter of this application is an improvement over that disclosed and claimed in pending application Ser. No. 731,393 filed Oct. 12, 1976 by Ralph E. Newton (the joint author of the present invention), now U.S. Pat. No. 4,066,926, which application is assigned to the same assignee as the present application.

BACKGROUND OF THE INVENTION

1. Field of the Invention

This invention relates to the electric lamp art and has particular reference to an improved integral fuse structure for a gas-filled incandescent lamp.

2. Description of the Prior Art

Incandescent electric lamps that contain an inert fill gas and are provided with an integral fuse component are generally well known in the art. A double-ended halogen-cycle incandescent lamp which contains a coiled-coil filament that is terminated by an uncoiled leg section which functions as a fuse and is fastened to the end of a lead-in conductor that is embedded in the envelope seal is disclosed in U.S. Pat. Nos. 3,211,942 (E. H. Wiley) and 3,211,950 (J. G. Cardwell, Jr.), both issued Oct. 12, 1965. A modified lamp of this type in which the combined functions of a fuse and a filament support are achieved by a wire member that is fastened to the embedded end of the lead-in conductor and has its opposite end wound around the singly-coiled leg segment of a coiled-coil filament to provide an interwound juncture is disclosed in U.S. Pat. No. 3,211,943, which was also issued to J. G. Cardwell, Jr. on Oct. 12, 1965.

A fuse assembly that constitutes an integral part of a double-ended incandescent lamp but is disposed within a ceramic cap attached to the press seal and is thus located outside of the lamp envelope is disclosed in U.S. Pat. No. 3,274,426, issued Sept. 20, 1966 to R. F. Scoledge et al. An improved exterior fuse assembly for such a lamp in which a separate support wire for the lamp contact is employed and connected to a protruding portion of the lead-in conductor by the fuse wire is shown in U.S. Pat. No. 3,346,768, issued Oct. 10, 1967 to G. F. Patsch.

Halogen-cycle type incandescent lamps having fuse elements in the form of rods or metal foils that are completely embedded in the press seals and connected to the ends of the coiled filament are disclosed in U.S. Pat. No. 3,710,169 (G. R. T'Jampens et al.), issued Jan. 9, 1973 and Japanese Patent Publication No. 47-11421 of Ito et al., published Apr. 27, 1972. A double-ended incandescent lamp having an internal fuse element in the form of a wire that is coiled around a separate spud wire which is connected to one end of the filament and is embedded in the press seal is disclosed in U.S. Pat. No. 3,864,598, issued Feb. 4, 1975 to J. G. Cardwell, Jr. The uncoiled end of the fuse wire is connected to a foil conductor embedded in the seal, thus completing the electric circuit. A single-ended halogen-cycle incandescent lamp having an internal fuse in the form of a coiled wire that is connected to the inwardly-extending ends of an internal lead wire and an external lead-in conductor assembly that are both embedded in the hermetic seal and both protrude into the envelope is disclosed in Japanese Patent Publication No. 48-30707 of Toyoda, published Sept. 19, 1973. A single-ended halogen-cycle projection type incandescent lamp with an internal platinized fuse wire is disclosed in U.S. Pat. No. 3,727,091 issued Apr. 10, 1973 to A. R. DeCaro.

While the prior art structures which employed external fuse components were generally satisfactory from a functional standpoint, they were rather complicated and expensive in that they required several accurately-formed parts to hold and protectively enclose the fuse assembly. Even though the expense of such additional parts was eliminated by using internal fuse components, the prior art practice of using a coiled fuse wire or coiling one end of an internal fuse wire around the filament leg or a spud wire made it difficult and expensive to manufacture the lamp since highly-skilled manual labor was required to make such assemblies. In addition, the resulting electrical juncture of the parts was not very rugged or reliable and left much to be desired from the standpoint of a positive and durable electrical connection. This is a particularly vexing problem in prior art halogen lamps that employ tungsten inner lead wires and tungsten wire fuses that are welded to each other (as in the aforementioned pending application Ser. No. 731,393, now U.S. Pat. No. 4,066,926, of R. E. Newton) insofar as such tungsten-to-tungsten welds are very difficult to control and make in the factory on a mass-production basis. This is due to the fact that the tungsten tends to crystallize and become brittle when heated during the welding operation.

In some cases, the spacing between the internal metal components of the lamp was so close that an electric arc could easily "bridge" the gap between them after the fuse element melted, thus preventing reliable arc-suppression as the lamp failed and creating a potential safety hazard.

SUMMARY OF THE INVENTION

The foregoing quality and manufacturing problems are avoided in accordance with the present invention by utilizing an internal fuse element that consists of a short length of uncoiled wire which is located inside the envelope and has both of its ends embedded in an hermetic seal of fused glass that is formed at the end of the lamp envelope. One end of the fuse wire is connected to a part of an inner lead-in conductor that is anchored in the press seal and the other end of the fuse wire is connected to the embedded portion of an outer lead-in conductor assembly that is separate and physically isolated from the inner lead-in conductor. The fuse wire is thus firmly held in place by the hermetic seal and both of the conductor-fuse wire junctures are protectively enclosed by the glass seal. The ends of the fuse wire are preferably connected to the inner and outer lead-in conductors by welding them to ribbon or foil conductors that are also welded to the respective conductors and embedded in the seal in spaced-apart relationship.

The invention is especially adapted for use in halogen-cycle incandescent lamps that have useful design lives in excess of 500 hours and as high as 2,000 hours and have molybdenum foil conductors that are embedded in the sealed ends of the envelopes. When thus employed, the fuse wire preferably consists of a tungsten wire that is spot-welded to the molybdenum foil conductors and has a diameter which is more than 10% and up to about 20% larger than the filament wire diameter. Fuse wires of such large cross-section are required to insure that the part of the fuse wire which is located within the envelope and exposed to the halogen atmosphere will operate at a lower temperature than the filament wire and thus remain in place and continue to be operative throughout the long useful life of the lamp despite the limited "halogen cycle" effect which occurs in the fuse region over the extended life of the lamp and can have a chemical etching action on the fuse wire.

The use of an uncoiled segment of wire as an interior fuse element and connecting it to separate physically-isolated inner and outer lead-in conductor components within the lamp seal provides an additional important advantage in that the "active" part of the fuse wire which is located within the envelope is exposed to the heat generated by the energized filament and thus has a much higher operating temperature than a fuse element which is completely embedded within the envelope seal or located outside the envelope. This permits the fuse wire to melt through faster and provide a quicker fusing action should an arc develop within the lamp. The novel fuse structure also provides a wide "gap" or spacing between the lead-in conductor components when the fuse has melted away, thus insuring positive and reliable arc-suppressing protection should the need arise.

BRIEF DESCRIPTION OF THE DRAWING

A better understanding of the invention will be obtained from the exemplary embodiments shown in the accompanying drawing, wherein.

DESCRIPTION OF PREFERRED EMBODIMENTS

While the present invention can be employed in various kinds of gas-filled incandescent lamps that require a fuse component to suppress electric arcs which may occur within the lamp during operation and could lead to the violent rupture of the envelope if the arc is not controlled, it is particularly adapted for use in long-life halogen-cycle type incandescent lamps and has accordingly been so illustrated and will be so described.

Figure 1:
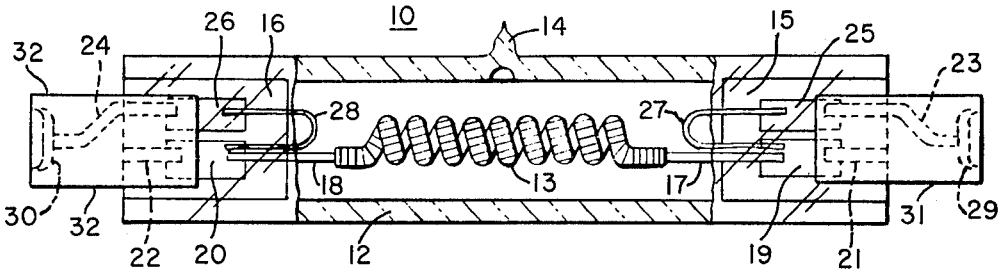
FIG. 1 is an enlarged elevational view of a double-ended halogen-cycle type incandescent lamp made in accordance with the invention, a central portion of the envelope being removed for illustrative purposes.

A representative halogen-cycle incandescent lamp 10 of the aforementioned type which is of double-ended construction and embodies the present invention is shown in FIG. 1. As illustrated, the lamp 10 comprises an elongated tubular envelope 12 that contains a filament 13 and is composed of a suitable radiation-transmitting vitreous material that has a high-melting point and can withstand the elevated operating temperatures and gas pressures involved, as well as the effects of the halogen atmosphere, without deteriorating or becoming deformed or bursting. Examples of suitable vitreous materials are quartz, borosilicate glass, and other hard glasses that principally comprise fused silica.

The envelope 12 is hermetically sealed by a protruding tipped-off segment 14 of an exhaust tubulation and by press seals 15 and 16 that are formed in the usual manner by heating and then collapsing and compressing the ends of the envelope to form a solid mass of glass or quartz. The filament 13 is composed of tungsten wire which is wound into coiled-coil configuration and longitudinally suspended and centrally located within the envelope 12. It is held in such position by a pair of rigid inner lead-in conductors, such as tungsten or molybdenum wires 17 and 18, that are anchored in the respective press seals and have their opposite ends inserted into and electrically connected with singly-coiled legs of the filament 13. The sealed-in ends of the inner lead-in wires 17 and 18 are connected (as by welding) to suitable foil conductors such as ribbon-like strips 19 and 20 of molybdenum that are hermetically embedded within the associated press seals.

Each of the foil conductors 19 and 20 has an additional rigid conductor such as a tungsten or molybdenum wire 21 and 22 welded or otherwise attached to its end. These additional conductors are both embedded in the respective press seals and extend toward and terminate at the end surfaces or faces of the seals. Each of the press seals 15 and 16 also include a rigid outer lead-in conductor 23 and 24 that are anchored in the respective seals and connected, as by welding, to another pair of foil conductors 25, 26 that are embedded in the seals in laterally-spaced relationship with the first pair of foil conductors 19, 20. The outer conductors are preferably fashioned from tungsten or molybdenum wires and the additional pair of foil conductors are also preferably ribbon-like strips of molybdenum.

The envelope 12 contains an inert fill gas (such as nitrogen, krypton, argon, xenon and mixtures thereof) at a suitable pressure, at least 760 Torr for example. It also contains a predetermined amount of a halogen additive, such as iodine or bromine, that is dosed into the lamp in elemental form or as part of a thermally-decomposable compound HBr, $SnI_4$ or methylene bromide for example). Lamps of this type having design lives in excess of 500 hours are made in various sizes and ratings ranging from 75 watts to 10,000 watts and 28 volts to 277 volts. A typical 1,000 watt lamp designed for operation at 120 volts has a useful design life of 2,000 hours.

In accordance with the present invention, the incandescent lamp 10 is provided with an integral fuse component at one or both ends. In the embodiment shown in FIG. 1, each end of the lamp 10 is provided with such a component. The assemblies consist of suitable fusible elements such as a pair of uncoiled pieces of tungsten wire 27 and 28 that are bent into generally U-shaped form and have their ends electrically connected, as by spot welding, to the adjacent pairs of foil conductors 19, 25 and 20, 26 embedded in the respective press seals 15 and 16. The bights or looped-end portions of the fuse wires 27, 28 extend inwardly into the envelope 12 from the associated seals, as shown in FIG. 1. These looped portions are accordingly inside the envelope 12 and thus serve as the "active" segments of the fuse elements. If desired, the anchored ends of the fuse wires may be attached to the embedded ends of the associated inner lead-in conductors instead of the foil conductors 19, 20. However, it is preferred that they be fastened to the foil conductors by welding and that the foil conductors be made of molybdenum since this permits the use of tungsten-to-molybdenum welds which are very strong and reliable and can be easily made in the factory. To facilitate the welding operation and strengthen the bond, a small piece of platinum is placed between the molybdenum foil and tungsten wire to act as a flux, or platinum-plated molybdenum foil is used.

As will be noted in FIG. 1, the protruding ends of the outer lead-in conductors 23 and 24 are fastened to metal contact buttons 29 and 30 which serve as the lamp terminals. The exposed ends of the outer lead-in conductors and their associated contact buttons are protectively enclosed and recessed within suitable housings such as ceramic sleeves 31 and 32 that are cemented to the press seals 15 and 16 in accordance with standard lamp-making practice.

The incandescent lamp 10 is thus provided with lead-in conductor and fuse assemblies which permit electric current to flow from terminal or contact button 29, through the outer lead-in conductor 23, the connecting foil conductor 25, fuse wire 27, the coiled-coil filament 13 and to the other contact button 30 through the interconnected end portion of the other inner lead-in conductor 18, fuse wire 28, foil conductor 26 and outer conductor 24.

Since both ends of the U-shaped fuse wires 27, 28 are embedded in the associated press seals, the fuse wires are securely anchored in place within the lamp 10 and, at the same time, are exposed to the intense heat generated by the incandescent filament 13. The inwardly-disposed looped portions of the fuse wires accordingly operate at a much higher temperature than the end portions that are embedded in the press seals and are thus inherently capable of being resistively-heated quickly to melting temperature when the lamp current increases rapidly — thus providing a reliable and fast "fusing action" which quickly suppresses any electric arc that may develop within the lamp 10 due to voltage surges or failure of the filament.

In order to avoid the possibility that the short lengths of fuse wire 27 and 28 will operate at an excessively high temperature or become so eroded or chemically etched by the hot halogen atmosphere and "halogen-cycle" effect during the long service life of the lamp as to melt through and prematurely render the lamp inoperative, it has been found that they must be fabricated from tungsten wire that is much larger in diameter than the tungsten wire from which the coiled filament 13 is wound. The diameter of the fuse wire is more than 10% and up to about 20% (and preferably from about 12% to 17%) larger than the filament wire diameter. It thus has a larger cross-sectional area and lower resistance per unit length than the filament wire. In the case of a 1,000 watt lamp designed for 2,000 hours operation at 120 volts and having a coiled-coil filament wound from tungsten wire approximately 0.295 millimeter in diameter, the foregoing criteria requires that the fuse wires be fabricated from tungsten wire from about 0.327 to 0.354 millimeter in diameter (11% to 20% diameter increase).

Using fuse wires that are so much larger in diameter than the filament wire affords the additional advantage that "nicks" or other surface imperfections in the fuse wire can be tolerated without creating "hot spots" in the wire during lamp operation which could also cause the fuse elements to melt through prematurely and ruin the lamp. This particular advantage applies to both halogen and non-halogen type lamps.

Figure 2:
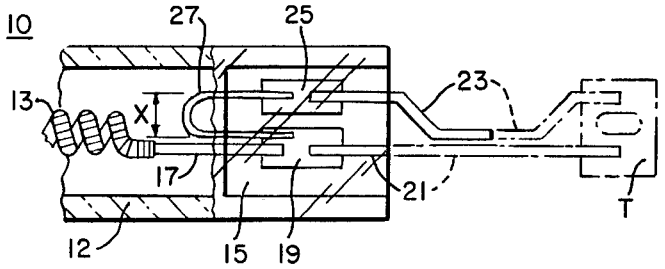
FIG. 2 is an elevational view of one end of the lamp shown in FIG. 1 before the external contact element and its protective sleeve have been attached.

The use of a pair of separate foil conductors that are connected to separate and physically-isolated inner and outer lead-in conductors which are electrically connected by a generally U-shaped fuse wire in accordance with the invention provides additional functional and manufacturing advantages. These features are shown in FIG. 2. As indicated by the dotted outline portions of this Figure, the outer lead-in wire 23 and additional lead-in wire 21 are initially longer and have their outer ends spot-welded to a metal bridging-tab T which holds the entire lead wire, foil and fuse assembly together while it is being attached to the leg of the coiled-coil filament 13 and embedded in the press seal 15. The resulting unitary assembly can thus be accurately and rapidly fabricated automatically using suitable jigs and welding equipment. After the assembly has been sealed within the envelope 12, the lead-in wire 21 is severed flush with the outer edge of the press seal 15 and the outer lead-in conductor 23 is severed at the proper point to provide a protruding portion of the required length.

The lead-in conductor and fuse wire components are so arranged and spaced that a wide "gap" (dimension "x" in FIG. 2) is provided between the embedded leg portions of the fuse wire 27 when the loop segment of the fuse wire that is located inside the envelope 12 has melted and been removed. This provides a very reliable and positive arc-suppression action. The wide "gap" is achieved by laterally-offsetting the paired foil conductors 19, 25 from each other and attaching the straight ends of the U-shaped fuse wire 27 in the manner shown. To insure positive arc-suppression, dimension "x" should be at least 2 mm. Of course, this dimension will vary depending upon the type of fill gas and fill pressure which are employed and the physical size of the lamp. Larger gap dimensions are required for higher fill pressures and with fill gases, such as argon, which has a low ionization potential (compared to nitrogen, for example). In 1,000 watt lamps of the type shown in FIG. 1 that contain 50% argon-50% nitrogen as the fill gas at a pressure of about 1700 Torr (at 20° C.) and have a quartz envelope 11.5 cm. long and 1.8 cm. in diameter, excellent fusing action and arc-suppression has been achieved with a gap dimension of approximately 4 mm. The fact that the fuse wire melts in such a manner that the melted remnants or "stubs" are automatically slightly recessed within and shielded by the press seal enhances the arc-suppression ability of the fuse assembly.

While the integral fuse elements 27 and 28 are preferably fabricated from tungsten wire to facilitate making the welds which join them to the foil conductors 19, 20, 25, 26 (or the embedded ends of the inner lead-in conductors 17 and 18), they can be fabricated from other suitable metals or alloys that have the proper electrical conductivity characteristics and will provide the desired fusing action. In the case of halogen-cycle type lamps with design lives over 500 hours, the fuse wire material must also be able to withstand the corrosive effects of the halogen atmosphere over the long service life of the lamp. It is thus within the scope of the invention to use fuse wires that are fabricated from uncoiled wire that is composed of a metal or alloy that is not tungsten but which is clad or coated with tungsten and is thus able to withstand the halogen atmosphere within the envelope. Fuse wires that are composed of platinum-coated nickel or Nichrome alloy wire in accordance with U.S. Pat. No. 3,727,091 granted Apr. 10, 1973 to A. DeCaro can thus also be used.

Figure 3:
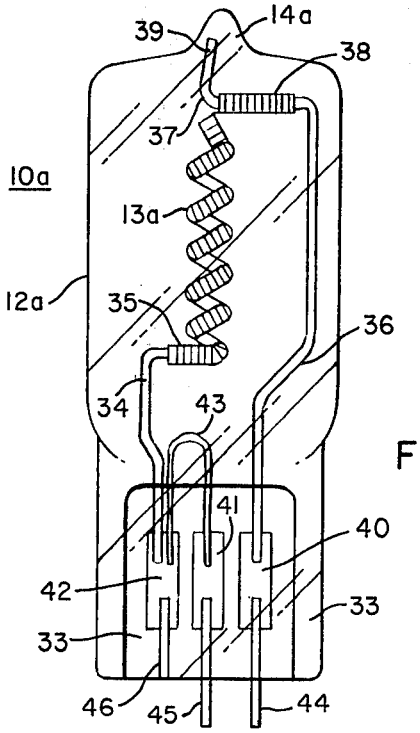
FIG. 3 is an enlarged elevational view of a single-ended lamp embodiment.

The invention is also not limited to incandescent lamps of double-ended construction. In an alternative lamp embodiment 10*a*, shown in FIG. 3, only one end of a short tubular envelope 12*a* is closed by a press seal 33 and a more compact coiled-coil filament 13*a* is centrally suspended within the envelope. The filament is held in this position by an inner lead wire 34 of short dimension and another inner lead wire 36 of much longer length, both of which are anchored in the press seal. The short lead-in wire 34 has a lateral end segment that is inserted into and attached to a laterally-extending leg 35 provided on the associated end of the filament 13*a*. The free end of the longer lead-in wire is formed into an L-shaped hook 37 that is slipped through a laterally extending leg 38 and an opening or "break" provided on the opposite end of the filament 13*a*. The upstanding end segment 39 of the L-shaped lead wire hook 37 engages the seal-tip 14*a* of the envelope 12*a* and thus rigidifies the lamp mount. A filament-mount assembly constructed in this manner is disclosed in U.S. Pat. No. 3,930,177 issued Dec. 30, 1975 to Jack Martin.

In accordance with this embodiment of the invention, the hermetic seal 33 is provided with three embedded foil conductors 40, 41 and 42 that are laterally spaced from one another. The outermost foil conductors 40 and 42 are attached to the long inner lead 36 and short inner lead 34, respectively. The embedded ends of the generally U-shaped fuse wire 43 in this embodiment are fastened to the center foil conductor 41 and to foil conductor 42 which is connected to the short lead wire 34. A pair of outer lead wires 44, 45 anchored in the press seal 33 and connected to foil conductors 40 and 41, respectively, serve as rigid terminals for the lamp 10*a*. The remnant of an additional lead-in conductor 45 is also embedded in the press seal 33 and fastened to foil conductor 41 and then terminated at the end face of the seal to facilitate lamp manufacture, as in the FIGS. 1–2 embodiment.

Lamp 10*a* can be a standard type incandescent lamp or of the halogen-cycle type, as in the case of the previously described embodiment. A suitable screw or bayonet type base can be attached to the press seal and connected to the outer leads to provide a lamp that is threaded or inserted into a mating socket.

We claim as our invention:

1. An electric incandescent lamp comprising;

a vitreous envelope that contains an inert fill gas and is terminated at one end by an hermetic seal which has a pair of spaced foil conductors embedded therein, a filament of refractory metal wire suspended within said envelope, an inner lead-in conductor having one end disposed within the envelope and fastened to said filament and its other end embedded in said hermetic seal and connected to one of the foil conductors, means for suppressing the formation of a destructive electric arc within the energized lamp when the filament fails comprising a non-coiled member of fusible metal that has each of its ends embedded in the hermetic seal and connected to the respective foil conductors with the medial portion of said member extending beyond said seal into the envelope and providing an electrical path between said foil conductors, and external connector means comprising an outer lead-in conductor that protrudes from said hermetic seal and has an end segment which is embedded in said hermetic seal and is electrically connected to the foil conductor which is not fastened to said inner lead-in conductor.

2. The gas-filled incandescent lamp of claim 1 wherein said hermetic seal has an additional conductor member embedded therein which extends from an exposed surface of the hermetic seal toward and is secured to the foil conductor that is fastened to the inner lead-in conductor.

3. The gas-filled incandescent lamp of claim 1 wherein;

the said one end of the envelope is of tubular configuration, said hermetic seal comprises a press seal that is defined by collapsed walls of the tubular end of said envelope which are compressed into a solid mass of fused vitreous material, and said foil conductors are disposed in side-by-side spaced relationship within the press seal.

4. The gas-filled incandescent lamp of claim 1 wherein said fusible metal member comprises a generally U-shaped length of wire the loop portion whereof is located within said envelope.

5. The gas-filled incandescent lamp of claim 4 wherein;

said envelope is terminated at each end by a press seal and said lamp is thus of double-ended construction, said inner lead-in conductor comprises a rigid wire, and said foil conductors are disposed in side-by-side relationship within the associated press seal and extend along the longitudinal axis of the envelope.

6. The gas-filled incandescent lamp of claim 4 wherein;

said lamp is of the single-ended type with an hermetic seal at only one end of the envelope, said seal has three spaced foil conductors embedded therein, said filament is fastened to a pair of inner lead-in conductors that are of unequal length, anchored in said seal, and arranged so that the filament extends between the ends of said inner lead-in conductors, the anchored ends of said inner lead-in conductors are connected to two of the three foil conductors, said generally U-shaped fuse wire is fastened to one of said foil conductors that is connected to one of said inner lead-in conductors and to the foil conductor that is not connected to either of said inner lead-in conductors, and a pair of outer lead-in conductors are partly embedded in and protrude from said seal, one of said outer conductors being fastened to the foil conductor that is not connected to either of said inner lead-in conductors, and the other of said outer conductors being fastened to the foil conductor which is not connected to either end of said fuse wire.

7. The gas-filled incandescent lamp of claim 1 wherein;

said filament is of coiled configuration and consists essentially of tungsten wire that is of substantially uniform diameter, said envelope also contains a halogen which provides a regenerative atmosphere within the energized lamp that returns vaporized tungsten to the filament and said lamp thus comprises a halogen-cycle lamp, and said non-coiled member of fusible metal comprises a segment of wire that does not chemically react with said halogen.

8. The halogen-cycle incandescent lamp of claim 7 wherein;

said fusible wire segment is composed essentially of tungsten, and said foil conductors are composed of molybdenum and welded to the ends of said fusible wire segment.

9. The halogen-cycle incandescent lamp of claim 7 wherein;

said lamp has a useful design life over 500 hours, and said fusible wire segment is composed essentially of tungsten and has a substantially uniform diameter which is more than 10% and up to about 20% larger than the filament wire diameter so that said fusible wire will remain intact throughout the useful design life of the lamp under normal burning conditions.

10. The halogen-cycle incandescent lamp of claim 9 wherein the diameter of said fusible tungsten wire segment is from about 12% to 17% larger than that of said filament wire.

* * * * *